US006883437B2

(12) United States Patent
Saxton et al.

(10) Patent No.: US 6,883,437 B2
(45) **Date of Patent: *Apr. 26, 2005**

(54) CENTER BEAM CAR WITH DEPRESSED CARGO-CARRYING AREA

(75) Inventors: Gregory J. Saxton, Portland, OR (US); John N. Niosi, Portland, OR (US); James Jarvis, Portland, OR (US)

(73) Assignee: Gunderson, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/706,898

(22) Filed: Nov. 13, 2003

(65) Prior Publication Data

US 2004/0094063 A1 May 20, 2004

Related U.S. Application Data

(63) Continuation of application No. 10/241,980, filed on Sep. 11, 2002, now Pat. No. 6,647,895, which is a continuation-in-part of application No. 10/022,601, filed on Dec. 17, 2001, now Pat. No. 6,523,464, which is a continuation-in-part of application No. 09/747,758, filed on Dec. 20, 2000, now Pat. No. 6,431,085.

(51) Int. Cl.[7] ..... B61D 11/00

(52) U.S. Cl. ..... 105/355; 105/404; 410/31; 296/311

(58) Field of Search ..... 105/355, 404, 105/238.1, 377.01, 377.03, 377.08, 396, 411; 410/31, 32, 34, 35, 44, 45; 296/31.1, 183.1, 39.2; 52/737.4, 738.1

(56) References Cited

U.S. PATENT DOCUMENTS

| | | | | |
|---|---|---|---|---|
| 2,996,020 A | | 8/1961 | Udstad | |
| 3,081,716 A | | 3/1963 | Szczepanik | |
| 3,195,944 A | * | 7/1965 | Simmons | 296/183.1 |
| 3,244,120 A | | 4/1966 | Taylor | |
| 3,480,321 A | * | 11/1969 | Brandt et al. | 296/183.1 |

(Continued)

OTHER PUBLICATIONS

Thrall Car Mfg. Prototype care with reduced height center position, at least as early as Sep. 2000.
BNSF "Flexibeam" center partition car No. 564,124, at least as early as Jun. 2000.
Gunderson Inc. Prototype car No. GBRX 20003 (five color photographs), public use as early as Jan. 1, 2001.

*Primary Examiner*—Frantz F. Jules
(74) *Attorney, Agent, or Firm*—Chernoff Vilhauer McClung & Stenzel LLP

(57) ABSTRACT

A center beam railroad freight car including a cover for the lateral surfaces of the top chord of the center beam to reduce cargo damage.

20 Claims, 14 Drawing Sheets

U.S. PATENT DOCUMENTS

| | | | | | |
|---|---|---|---|---|---|
| 3,713,400 | A | | 1/1973 | Teroli | |
| 3,734,031 | A | | 5/1973 | Wagner | |
| 3,774,554 | A | | 11/1973 | O'Neill et al. | |
| 3,814,028 | A | | 6/1974 | Adler | |
| 3,964,399 | A | | 6/1976 | Miller et al. | |
| 4,024,821 | A | | 5/1977 | Yang | |
| 4,079,676 | A | | 3/1978 | Miller | |
| 4,081,941 | A | | 4/1978 | Van Ausdall | |
| RE30,338 | E | | 7/1980 | Kauder | |
| 4,236,459 | A | | 12/1980 | Teoli | |
| 4,331,083 | A | | 5/1982 | Landregan et al. | |
| 4,543,887 | A | | 10/1985 | Baker | |
| 4,626,017 | A | | 12/1986 | Robertson | |
| 4,690,072 | A | | 9/1987 | Wile et al. | |
| 4,753,175 | A | | 6/1988 | Harris et al. | |
| 4,784,067 | A | | 11/1988 | Harris et al. | |
| 4,802,420 | A | | 2/1989 | Butcher et al. | |
| 4,951,575 | A | | 8/1990 | Dominguez et al. | |
| 4,976,490 | A | * | 12/1990 | Gentle | 296/183.1 |
| 5,024,567 | A | | 6/1991 | Dominguez et al. | |
| 5,088,417 | A | | 2/1992 | Richmond et al. | |
| 5,150,940 | A | * | 9/1992 | Kennedy | 296/39.2 |
| 5,308,675 | A | * | 5/1994 | Crane et al. | 428/120 |
| 5,582,495 | A | | 12/1996 | Schroeder | |
| 5,626,083 | A | | 5/1997 | Saxton | |
| 6,183,176 | B1 | * | 2/2001 | Weiner | 410/32 |
| 6,199,486 | B1 | | 3/2001 | Landrum et al. | |
| 6,237,506 | B1 | | 5/2001 | Forbes | |
| 6,470,808 | B1 | * | 10/2002 | Clark et al. | 105/404 |
| 6,494,146 | B1 | | 12/2002 | Landrum et al. | |
| 6,592,174 | B1 | * | 7/2003 | Rollin et al. | 296/190.08 |
| 6,758,584 | B2 | | 7/2004 | Bach et al. | |

* cited by examiner

CENTER BEAM CAR WITH DEPRESSED CARGO-CARRYING AREA

CROSS-REFERENCE TO RELATED APPLICATIONS

This application is a continuation of patent application Ser. No. 10/241,980, filed Sep. 11, 2002, now U.S. Pat. No. 6,647,895 which is a continuation-in-part of patent application Ser. No. 10/022,601 filed Dec. 17, 2001, now U.S. Pat. No. 6,523,484 which is a continuation-in-part of patent application Ser. No. 09/747,758, filed Dec. 20, 2000, now U.S. Pat. No. 6,431,085.

BACKGROUND OF THE INVENTION

The present invention relates to freight-carrying railroad cars of the type known as center beam or center partition bulkhead flat cars, and in particular relates a center beam for a center beam car providing enhanced protection for the car's cargo.

Center partition bulkhead flat cars, commonly known as center beam cars, have been known for over 30 years and are depicted, for example, in Taylor U.S. Pat. No. 3,244,120, Wagner U.S. Pat. No. 3,734,031, Baker U.S. Pat. No. 4,543,887, and Saxton U.S. Pat. No. 5,758,584. Evolving design of such railroad cars has been directed generally toward cars with ample strength but of lighter tare weight in comparison to their cargo-carrying capacity. Construction of center beam cars of lighter weight with load-carrying floors located at a uniform height along the length of the car body leaves their load capacity limited by the available space.

Dominguez, et al., U.S. Pat. No. 4,951,575 discloses a center beam car in which a longitudinally intermediate portion of the load-carrying floor on either side of the center beam is located at a lower height than the load-carrying floors located in end portions of the car above the trucks on which the car body is carried. In the intermediate portion of such a car, crossbearers extend between lowered portions of the side sills of the car body and are supported beneath the center sill.

The car disclosed by Dominguez, however, has a conventional box-beam center sill structure, and the crossbearers of the car are attached to the center sill by hanger plates attached to the opposite sides of the center sill and extending downward to support an upper flange portion of each of the crossbearers. The structure of the car shown in the Dominguez et al. patent is thus unnecessarily heavy, making such cars expensive to build and operate.

In most previously available center beam cars the center of gravity has been relatively high because the entire load has been carried above the height of the trucks, but also at least partly as a result of the height of the center partition extending as high as the bulkheads on the ends of the car.

The space above the floor on each side of the center beam forms a bunk upon which bundles of cargo, typically wood products, can be stacked. When the bundles are stacked, they are typically secured by cables or straps that extend from a winch device mounted on the periphery of the floor to a top fitting on the center beam. When the cable or strap is tightened it exerts a force inwardly and downwardly so that the stack leans toward the longitudinal centerline of the car and is pulled tight against the center beam.

The bundles are often wrapped in a plastic sheet to protect the goods from rain and snow, and to discourage embedment of abrasive materials such as sand in valuable goods, such as wood. The plastic sheet typically comprises polyethylene, but may comprise another plastic material.

In previously known center beam cars, various components of the center beam are interconnected in such a manner as to present edges or fastening devices which could rub on the cargo. In addition, when the cables or straps are tightened, the innermost, uppermost elements of the topmost bundle bear against the top chord of the center beam. As the car moves, vibration and inertia cause the stacked cargo to move relative to the center beam. Exposed edges or fastening devices in the center beam structure often abrade, tear, or damage the protective plastic sheeting. Portions of the cargo bearing against the center beam can be physically damaged as a result of contact with exposed edges or projections. Moreover, damaged sheeting may permit entry and collection of moisture and dirt leading to discoloration and the growth of mold on wood products. The resulting loss of value for the cargo can be substantial.

Forbes, U.S. Pat. No. 6,237,506, discloses a smooth, non-consumable panel facing for a portion of the posts of a center beam. The smooth facing protects the plastic sheeting from tearing by reducing exposure to projections and sharp edges on the posts. However, a facing applied to the posts of the center beam does not protect the portion of the sheeting in contact with the top chord of the center beam. Abrasion induced by friction and relative movement of the cargo and the top chord can cause rapid failure of the plastic sheeting exposing the goods to a hostile environment.

What is desired, then, is a center beam or center partition bulkhead flat car defining greater useable cargo-carrying volume and having ample strength yet having lighter tare weight than previously available cars of the type, and in particular including improved center sill and crossbearer structures. What is further desired is a center beam car in which the center beam is constructed so as to be substantially free of edges and projections that can damage the cargo or its containers or coverings and in which the top chord is constructed so as to reduce damage resulting from relative movement of the car and its cargo.

SUMMARY OF THE INVENTION

The present invention responds to the aforementioned needs by providing a modified center partition bulkhead flatcar including a center sill extending longitudinally along the car's body, a center beam extending along the center sill with a top chord of the center beam spaced upwardly above the center sill and connected to it by upright members, and including crossbearers each attached to and extending transversely beneath the center sill and supporting a floor on each side of the car body, and wherein in an intermediate portion of the center sill located between the opposite ends of the car body, a bottom plate of the center sill extends laterally outward beyond the side plates of the center sill and acts as an inboard portion of the floor structure.

In one embodiment of this aspect of the invention the crossbearers are of inverted "T" construction including an upright web and a horizontal bottom flange, with a central portion of the flange, located beneath the center sill of the car, being thicker than outboard portions of the bottom flange.

In one embodiment of this aspect of the invention a stringer extends longitudinally along the underside of the bottom plate of the center sill.

A railroad car according to another aspect of the present invention includes an integrated center sill and floor structure in a portion of the body of the car in which the center sill includes a pair of center sill side plates spaced a first distance apart from each other laterally, a center sill bottom plate extending along the bottom margins of the side plates and extending laterally outward beyond each of the side plates, a plurality of crossbearers interconnected with the center sill beneath the bottom plate, a floor sheet mounted atop the crossbearers and extending laterally outward from the bottom plate, and a stringer attached to the underside of the bottom plate at a location outboard from the pair of side plates of the center sill and extending longitudinally from one of the crossbearers to another, forming an integrated structure including the center sill and floor structure.

In one preferred embodiment of this aspect of the invention the crossbearers each include an upstanding web and a horizontal bottom flange forming an inverted T configuration and each crossbearer has opposite ends attached to side sills of the car.

In another preferred embodiment of this aspect of the invention a semi-cylindrical gusset interconnects the bottom plate of the center sill and the web of each crossbearer.

As another aspect of the invention a body bolster in a railroad car according to the present invention includes a pair of arms each extending laterally outward and diagonally upward from the center sill in an end portion of the car to a respective side sill, and a floor support riser is attached to an upper face of each arm of the body bolster and provides support for a floor sheet extending laterally inward from the side sill toward the center beam in the end portion of the car.

In a preferred embodiment of this aspect of the invention longitudinal floor support stringers are carried on a horizontal top face of the floor support riser.

In another aspect of the invention the center beam includes upright members which extend from the center sill to the top chord and which are attached in such a manner that the surfaces presented to cargo are coplanar and free of projections that could damage the cargo.

In another aspect of the invention, the top chord of the center beam comprises a selectively affixable, lateral face arranged to contact and resist lateral displacement of the cargo while facilitating movement of the cargo in directions generally parallel to the lateral face.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
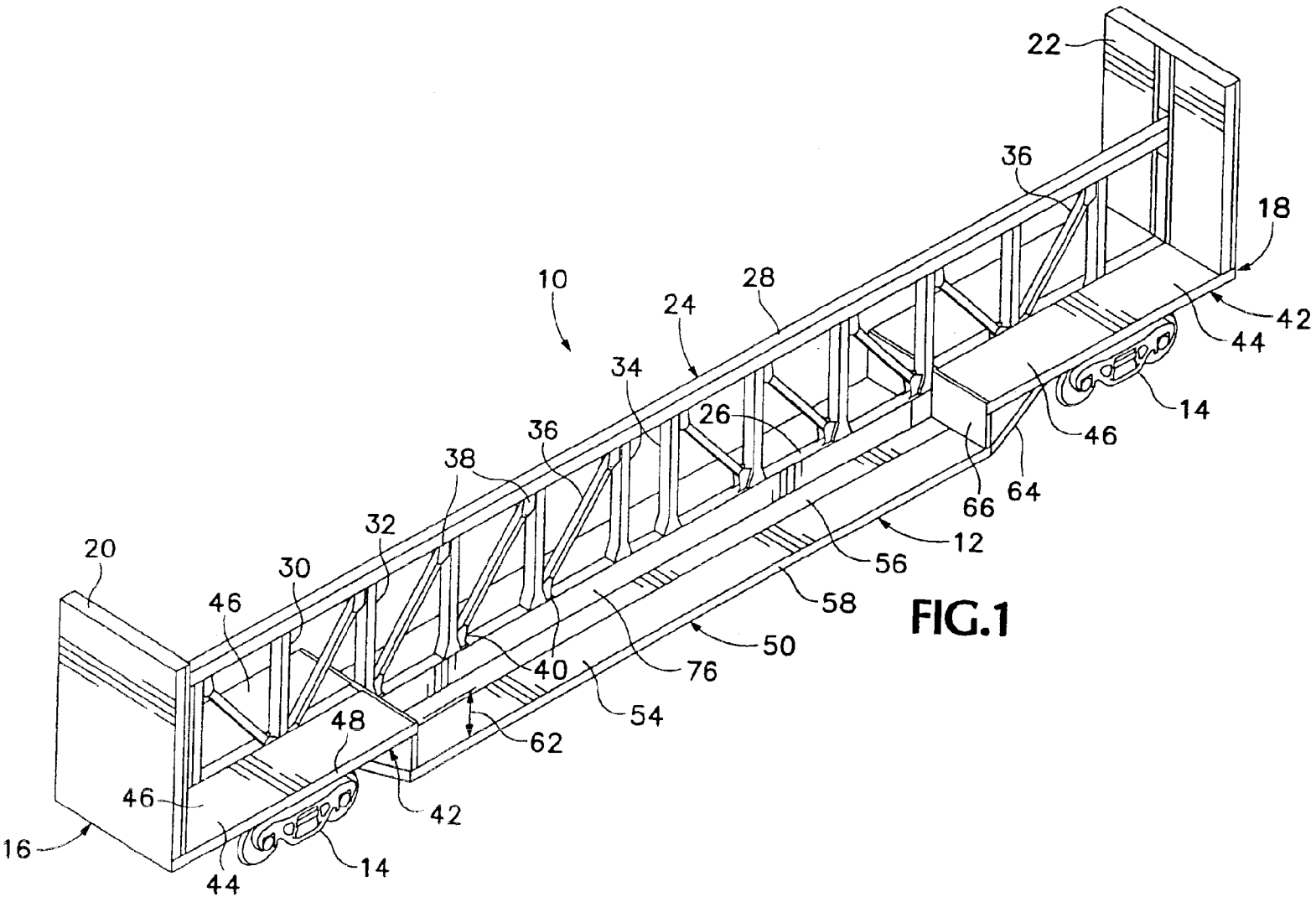
FIG. 1 is an isometric view of a center beam railroad freight car embodying the present invention and including a car body in which a longitudinally intermediate portion includes cargo-carrying floors located at a lower height than cargo-carrying floors in the respective end portions of the car body.

Referring to the drawings which form a part of the disclosure herein, as may be seen in FIG. 1, a center beam car 10 embodying the present invention has a car body 12 of welded steel construction carried on a pair of wheeled trucks 14 located at respective opposite ends 16 and 18 of the car body 12.

Bulkheads 20, 22 are located at the opposite ends 16 and 18, and a center beam 24 extends longitudinally of the car body 12 between the bulkheads 20 and 22.

Figure 2:
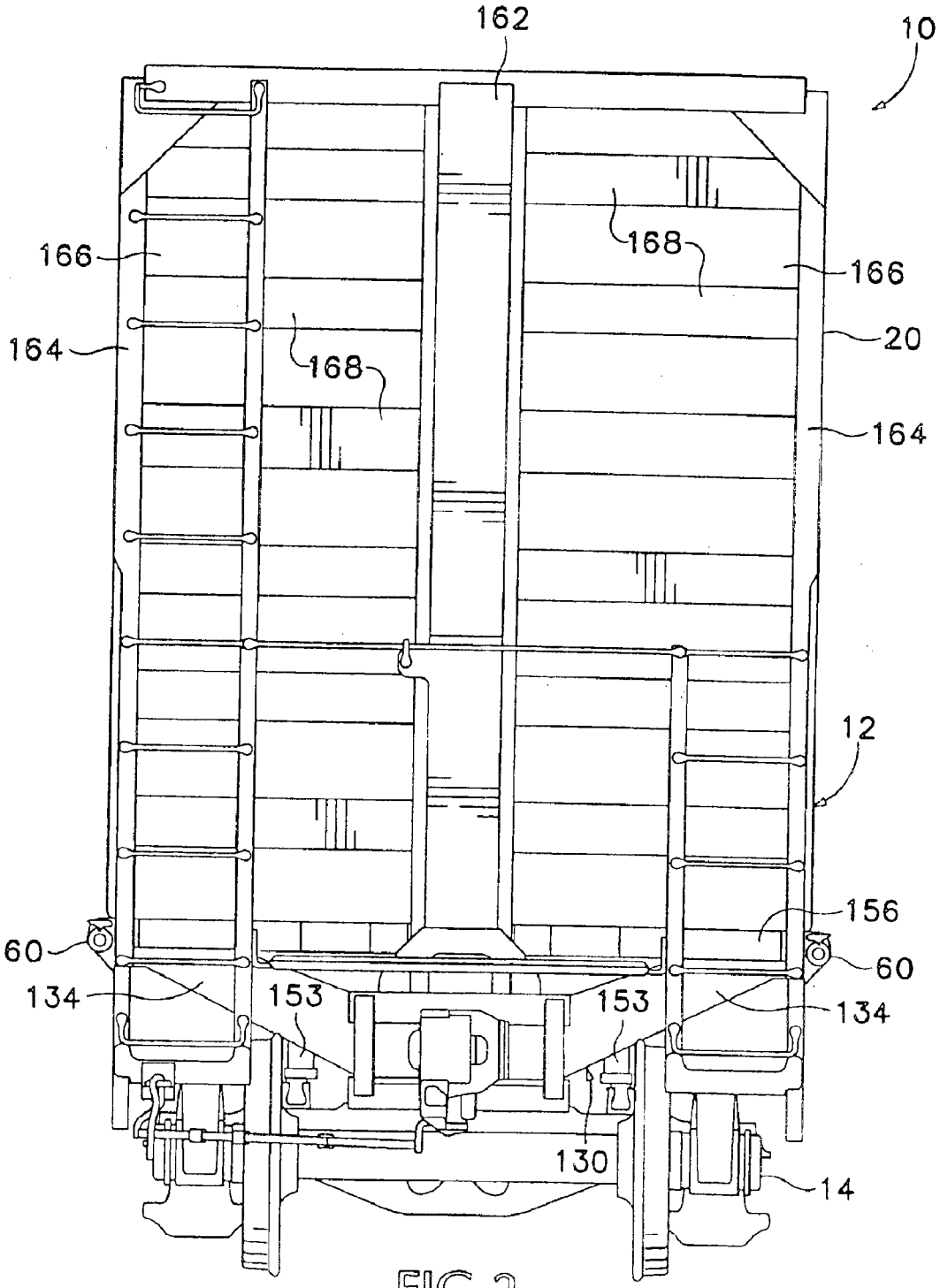
FIG. 2 is an end elevational view of the center beam railroad car shown in FIG. 1.
Figure 3:
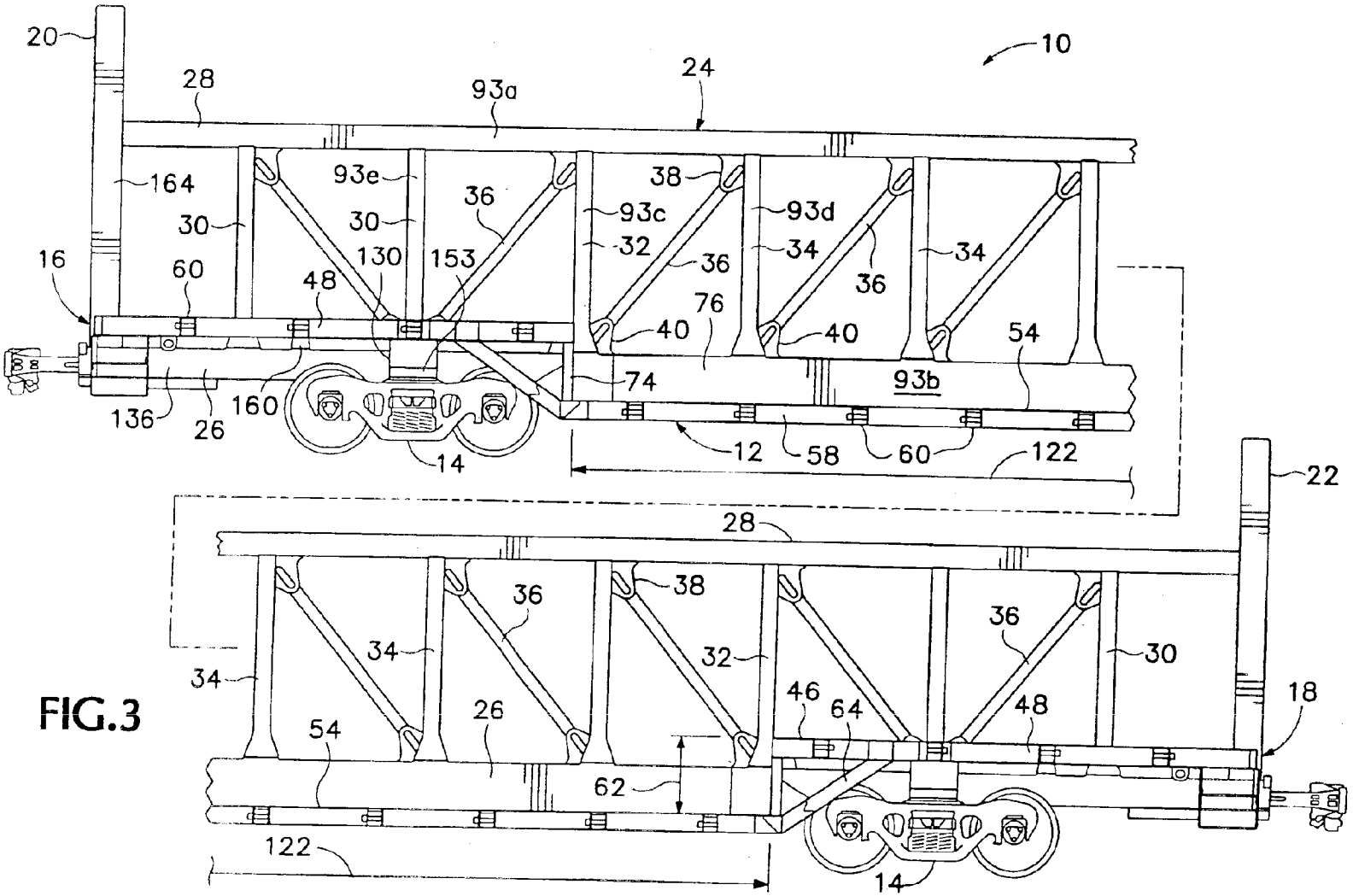
FIG. 3 is a side elevational view of the center beam railroad car shown in FIGS. 1 and 2.
Figure 19:
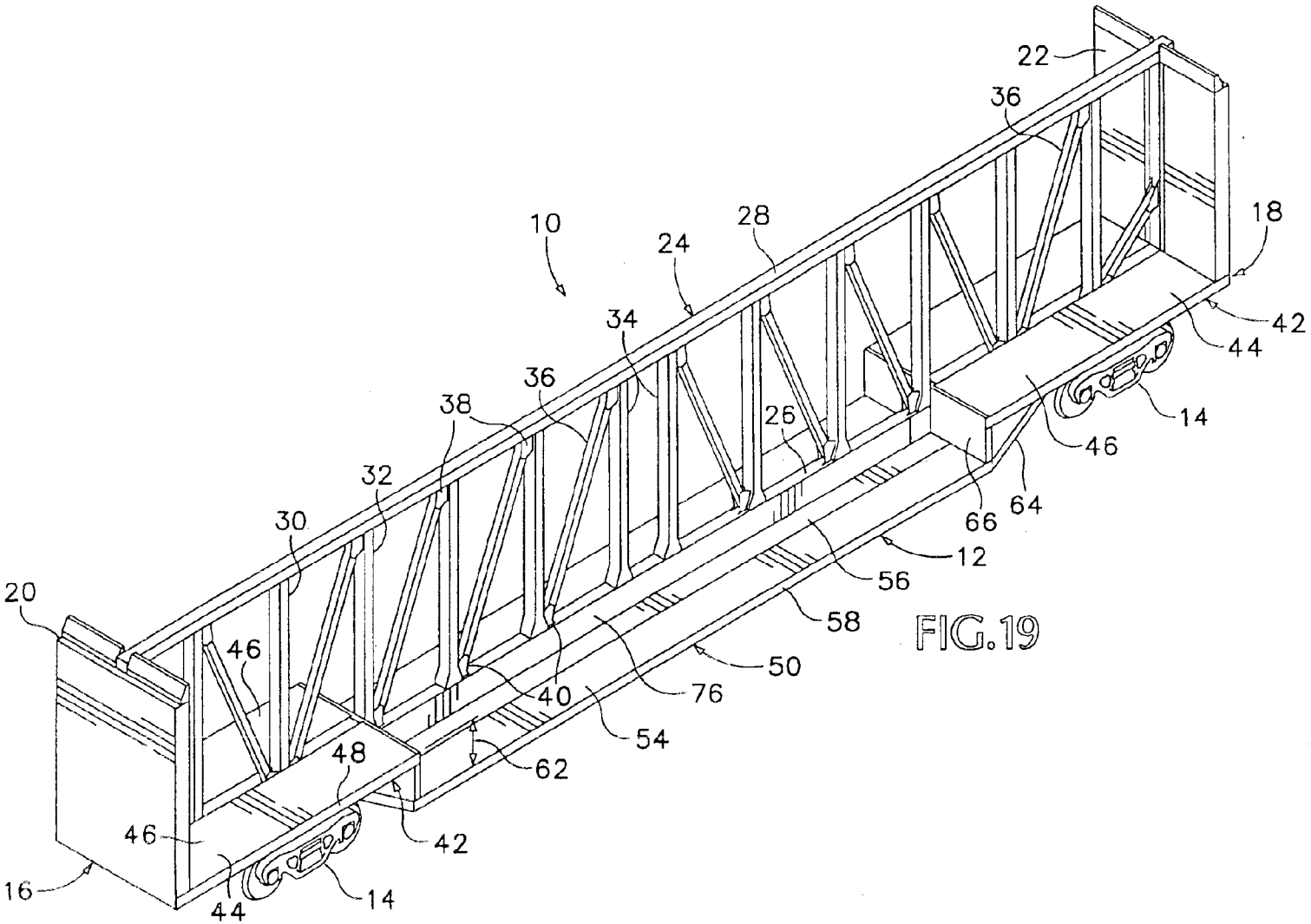
FIG. 19 is an isometric view of a center beam railroad freight car which is another embodiment of the present invention and includes a car body in which a longitudinally intermediate portion includes cargo-carrying floors located at a lower height than cargo-carrying floors in the respective end portions of the car body and in which the top chord of the center beam is at a height proximate the tops of the bulkheads.

Referring also to FIGS. 2 and 3, the car body 12 includes a center sill 26 that extends from the first end 16 to the other end 18. The center sill 26 acts as part of the bottom chord or flange of the center beam 24. A top chord 28 of the center beam extends longitudinally along the car body 12 a distance above and parallel with the center sill 26 from the bulkhead 20 to the bulkhead 22, and is attached structurally to each of the bulkheads 20 and 22. While the top of the center beam 24 is shown as having a height less than that of the tops of the bulkheads 20 and 22, the car 10 could also be constructed with a center beam 24 of greater height, at least up to nearly as high as the tops of the bulkheads 20 and 22, as illustrated in FIG. 19.

Vertical columns 30, 32 and 34 in the form of fabricated I-beams extend upward from the center sill 26 to the top chord 28 as the web of the center beam 24. The top chord 28 may, for example, comprise 10"×10" square tubing 29 of ½-inch wall thickness. The lower ends of the columns 30 are flared outward to be broader than the upper portions of the columns, and to match the width of the center sill 26 at the location where each is attached to the center sill 26. The upper portions of the columns 30, 32, and 34 are, for example, of welded steel plate.

The vertical columns 30, 32 and 34 are attached to the center sill 26 with ample strength and in such a way that the surfaces presented to the cargo where they are attached are smooth and free of edges or projections that could damage cargo, as will be explained in greater detail presently.

Square tubular diagonal members 36 are somewhat smaller than the columns 30, 32, and 34 and are attached to respective ones of the columns and to the center sill 26 and top chord tube 29 by upper end gusset plates 38 and lower end gusset plates 40 welded into place on each side of each diagonal member 36. The gusset plates 38 and 40 are welded to the transverse web plates of the respective columns, as well as to the top of the center sill and the underside of the top chord tube 29.

Each of a pair of end portions 42 of the car body 12 includes the respective bulkhead 20 or 22 and extending beyond the respective truck 14. A generally horizontal upper level cargo floor 44 is located alongside the respective columns 30 on each lateral side of the center beam 24 in each end portion 42. The floor 44 in each end portion 42 includes a floor sheet 46 on each of the laterally opposite sides of the center beam 24. Each floor sheet 46 extends along and is attached to a respective end portion side sill 48, as will be explained more fully below.

An intermediate portion 50 of the car is located between the two end portions 42. The intermediate portion 50 includes a depressed cargo-carrying floor located on each lateral side of the center beam 24 at a significantly lower height than that of the upper level cargo floors 44 in each of the end portions 42. Whereas the floor sheets 46 are located at a height above the top of the center sill 26, floor sheets 54 of the depressed floor extend in substantially coplanar alignment with a bottom plate 56 of the center sill 26, as is shown most clearly in FIG. 6, so that cargo carried in the intermediate portion 50 can be placed alongside and in contact with the center sill 26.

Figure 6:
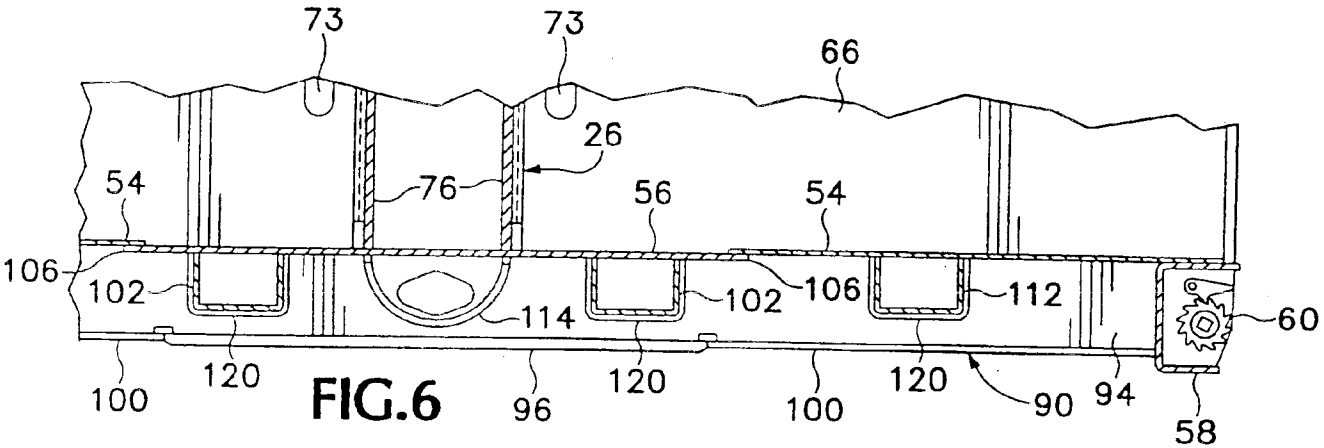
FIG. 6 is a sectional view of a portion of the railroad car shown in FIG. 4, taken along line 6—6.

An outboard margin of each floor sheet 54 is attached to and supported by a respective intermediate portion side sill 58, which may be a channel with unequal flanges of bent plate construction, as is seen best in FIG. 6. Preferably, the side sill 58 channel is formed of 5/16 inch steel plate, and has its flanges facing outboard to provide a protected location for cargo tie-down strap spools 60 in the intermediate portion 50 of the car body 12.

A height difference 62 between the floors 44 and the floor sheets 54, shown in FIGS. 1 and 3, is preferably equal to or a multiple of the usual height of a package of goods, for example a bundle of plywood, intended to be carried on the center beam car 10. For example, the height difference 62 may preferably be about 33 inches, equal to the height of a bundle of plywood including its packaging and leaving room for stickers providing clearance beneath the plywood for the forks of a forklift truck or other cargo-handling equipment.

A floor support transition portion of the car body 12 includes diagonal structural members 64, which may be channels, and a shear plate 66 located on each side of the center sill 26 and supported by stiffening channel structures 68, 70 and 72. Reinforcing angles 73 seen in FIGS. 6 and 8 assist in reinforcing the shear plates 66 and connecting the shear plates 66 with the side plates 76 of the center sill 26. Transitional side posts 74 on each side of the car body interconnect the upper, or end portion side sills 48 with the intermediate portion side sill 58.

Referring now to FIGS. 4, 5, 6 and 7, in the intermediate portion 50 of the car body 12, the center sill 26 is integrated with the structure of the floors on either side of the center sill. As shown best in FIG. 6, the center sill 26 in the intermediate portion 50 of the car includes a pair of parallel upright side plates 76 having a thickness 78 of, preferably, 5/16 inch plate, extending longitudinally and spaced apart laterally by a distance 80 of, for example, 9⅜ inches. A top plate 82 spans the distance 80, for example, between the upright side plates 76 and interconnects them near an upper margin of the center sill, as may be seen in FIG. 6. The top plate 82 has a thickness 84 that is greater than the thickness 78 of each side plate 76. For example, the thickness 84 may be ⅜ inch.

The bottom plate 56 is welded to the bottom margins of the side plates 76 and extends horizontally outward beyond the side plates 76 by a distance 86 of, for example, 16 inches, on each side of the center sill 26, so that the center sill 26 in the intermediate portion 50 of the car body 12 thus has the form of a closed rectangular box with a laterally extending flange on each side of its bottom face. The bottom plate 56 preferably has a thickness 88 which is similar to the thickness 78 of each side plate 76. For example, the thickness 88 is preferably 5/16 inch. The distance 86 should be at least half the distance 80 and is preferably greater than the distance 80, so that the bottom plate 56 includes ample material to carry the forces developed in the bottom of the center beam 24, although the weight of the bottom plate 56 is spread laterally. The bottom plate 56 thus is available to act as a portion of the cargo supporting floor structure and to aid in providing stiffness of the center sill to resist lateral bending in the intermediate portion 50 of the car 10.

Figure 10:
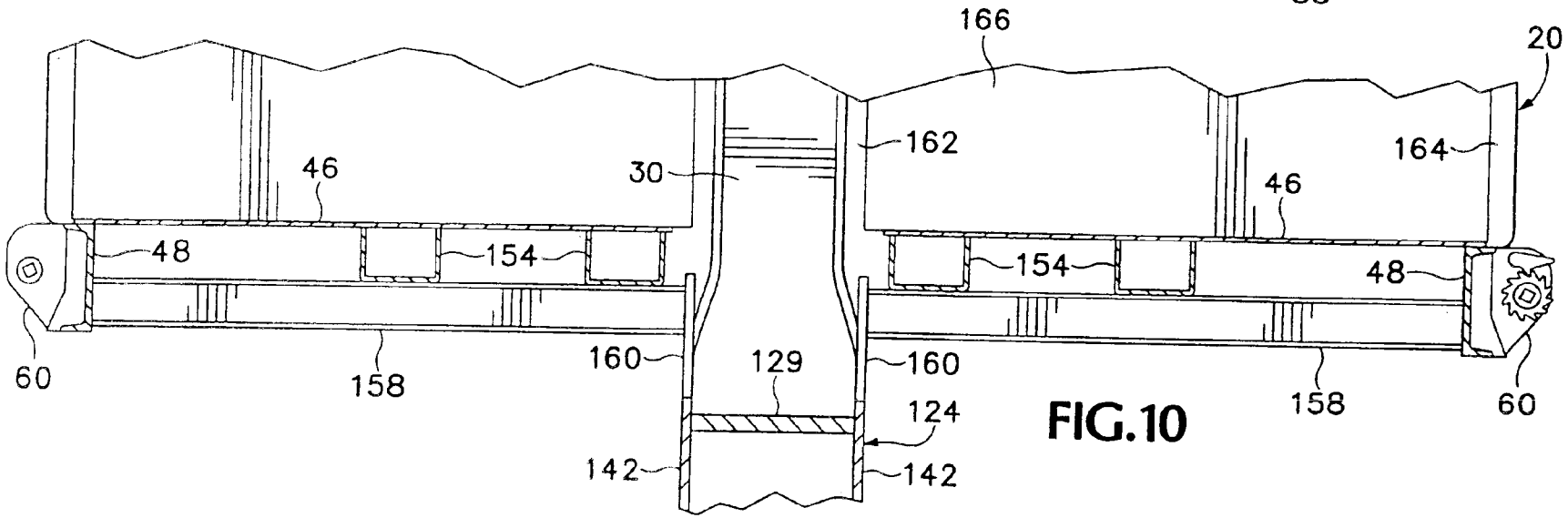
FIG. 10 is a sectional view of the center beam railroad car shown in FIG. 4, taken along line 10—10.
Figure 7:
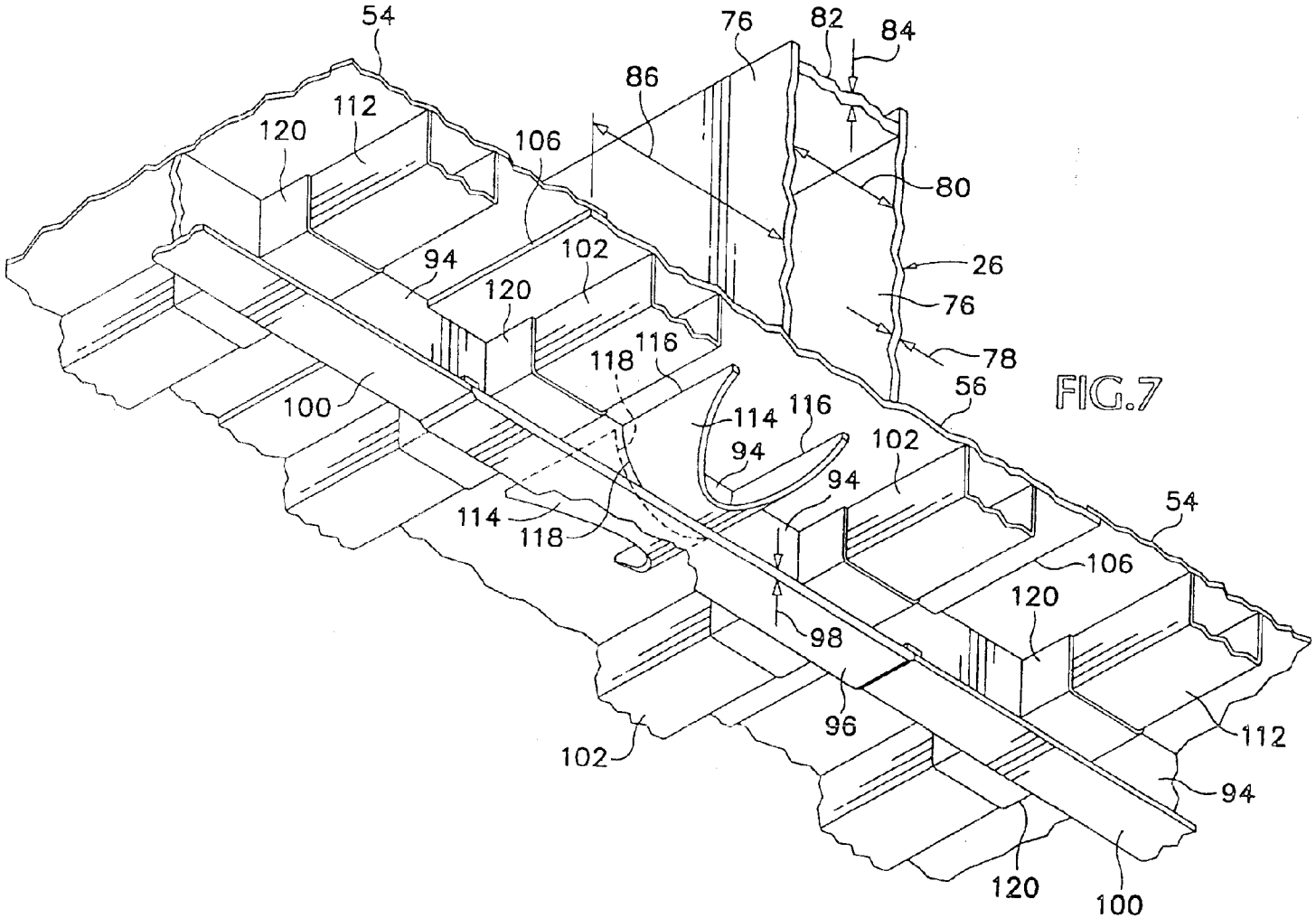
FIG. 7 is an isometric view of a portion of the center sill and floor structure of the center beam railroad car shown in FIGS. 1–6, taken from the underside of the intermediate portion thereof.
Figure 11:
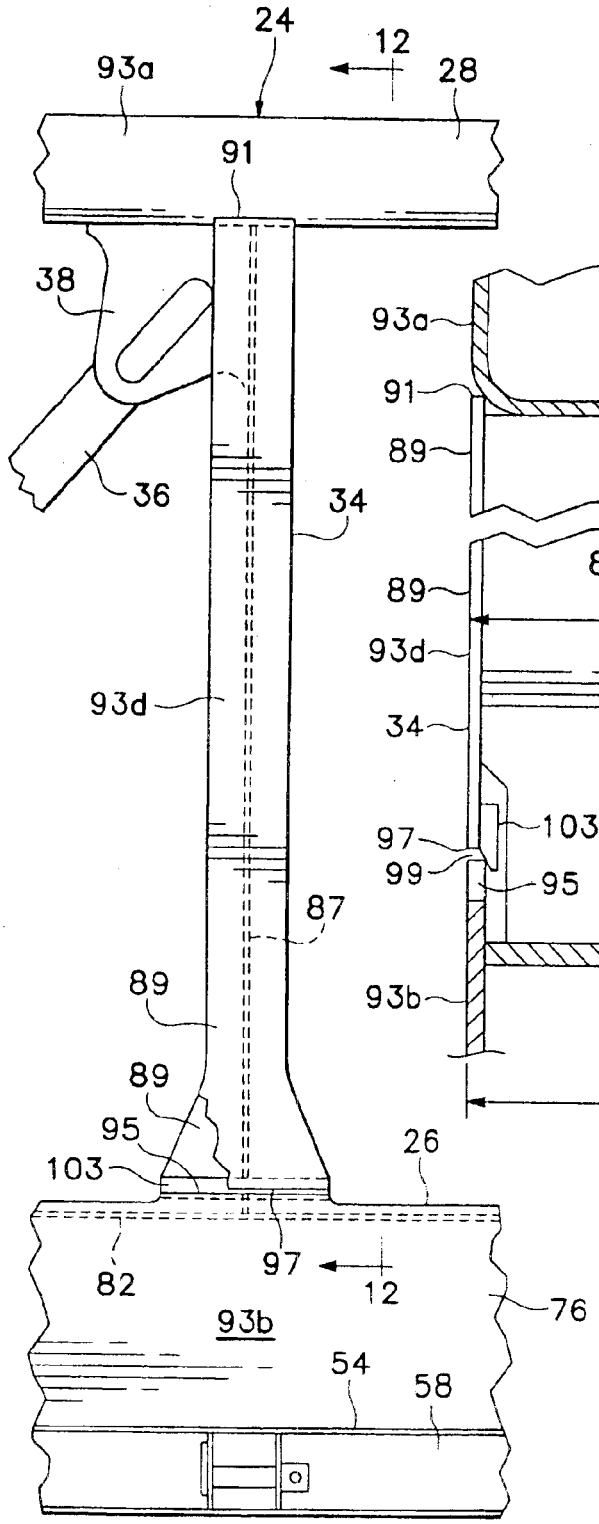
FIG. 11 is a side elevational view showing the manner in which a column is interconnected with the center sill and the top chord in the intermediate portion of the center beam railroad car shown in FIG. 3, at an enlarged scale.
Figure 12:
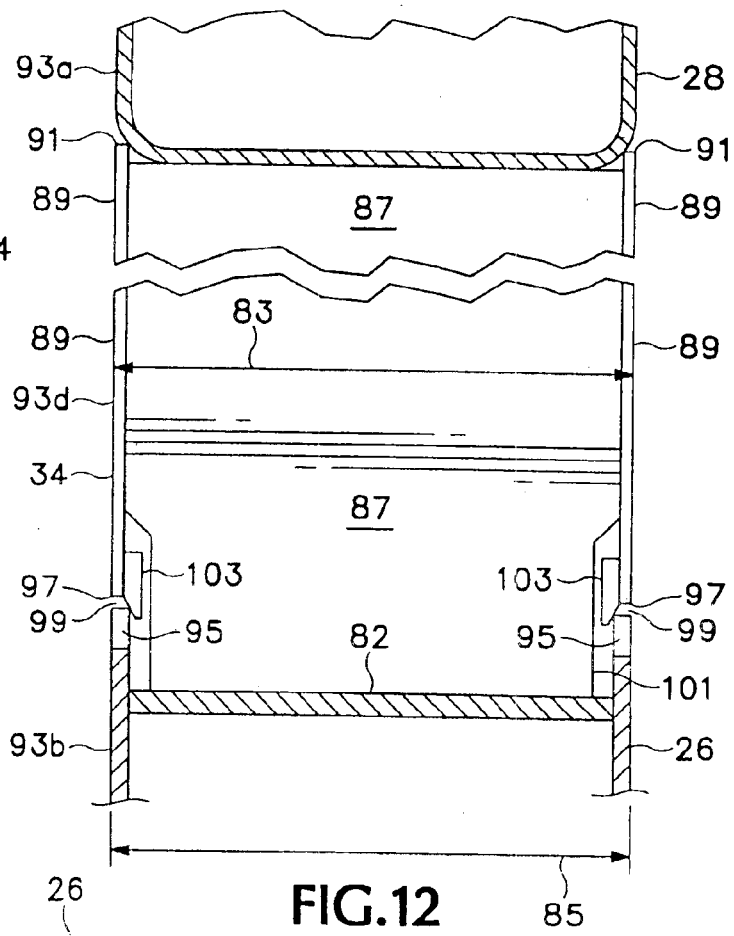
FIG. 12 is a sectional view, taken along line 12—12 of FIG. 11 at an enlarged scale, showing the interconnection of the vertical column with the center sill and the top chord tube.

As shown best in FIGS. 11 and 12, the columns 30, 32 and 34 extend upward from the center sill 26 to the top chord 28. While only a single column 34 is shown in FIGS. 11 and 12, the interconnections of the columns 30 and 32 with the top chord 28 and the center sill 26 are similar except at the bottom of columns 30 (shown in FIGS. 9 and 10). The columns 32 and 34 each have a width 83 equal to the width 85 of the center sill 26 in the intermediate portion 50 of the car 10, and are constructed as fabricated I-beams each having a transverse web plate 87 fitting between a pair of flange, or side, plates 89 extending vertically and longitudinally and aligned with the side plates 76 of the center sill 26. The upper end 91 of each of the columns is welded to the underside of the top chord tube 29, as seen best in FIG. 12, to present a continuous planar surface including one lateral face 93*a* of the top chord 28.

Each of the side plates 76 of the center sill 26 includes upwardly projecting portions 95 whose lengths and locations along the center sill 26 correspond with the bottom margins 97 of the flange plates 89 of the columns 30, 32, and 34, as may be seen in FIGS. 3 and 11. Each of the flange plates 89 of each column includes a broad bottom margin 97 to provide ample material to be welded to the center sill 26. Above the bottom margin 97 each flange or side plate 89 is tapered to a narrower width that continues for the majority of the length of each column. Each flange plate 89 is located above, and is aligned with, an upwardly projecting portion 95 of a respective side plate 76 of the center sill 26 so that the respective laterally outer faces 93*a*, 93*b*, 93*c* and 93*d* of the top chord 28, the center sill 26, and each of the columns 32 and 34, are all coplanar with each other on each lateral side of the center beam 24 in the intermediate portion 50 of the car 10. The lateral faces 93*e* of the portions of each column 30 above the end portion floors 44 are similarly coplanar with the lateral faces of columns 32 and 34 and the top chord 28.

The lower end of each of the columns 32 and 34 is welded to the top of the center sill 26 as shown in FIG. 12 to provide a connection with ample strength and a joint surface free from exposed edges or projections that might catch or cause wear on the surfaces of cargo or packaging. The lower end of the central web plate 87 is welded to the top of the top plate 82 of the center sill 26, preferably leaving a small gap 99 between the bottom margin 97 of each flange plate 89 and the adjacent projecting portion 95 of the side plate 76. A portion of each side of the web plate 87 is cut out as shown at 101, leaving room for a backing bar or doubler plate 103 to be attached flush against the inner face of each flange plate 89 where the bottom margins 97 of the flange plates 89 face the projecting portions 95 of the side plates 76.

The doubler or backing bar 103 is ideally of bar stock whose thickness is similar to that of each of the side plates 76. Each backing bar or doubler plate 103 has a chamfered bottom surface that bridges the gap 99 and accounts for the difference in thickness between side plates 76 of the center sill 26 and the thinner flange plates 89 of the column 32 or 34. The backing bar 103 thus supports and adds strength to the welded connection between the bottom margins 97 of the flange plates 89 and the side plates 76, while permitting the outer surface of the interconnecting weld to be smooth and coplanar with laterally outer faces of the side plate 76 and the flange plate 89.

In order to support the cargo-carrying floor in the intermediate portion 50 of the car at the relatively low height of the bottom plate 56, lower than the height of the tops of the wheels of the trucks 14, several crossbearers 90 extend transversely beneath and are attached to the center sill 26. Each of the opposite ends 92 of each crossbearer 90 is welded to the respective side sill 58. Each crossbearer 90 includes an upstanding web member 94 and a horizontal bottom chord or flange of which a central portion 96 is of relatively thick steel plate, having a thickness 98 of, for example, ⅝ inch. Outboard portions 100 of the flange of the crossbearer 90 are preferably of thinner material such as steel plate 5⁄16 inch thick, which is amply strong for the loads imposed, while the greater thickness 98 of the central portion 96 of the flange is desirable to carry the compressive loads imposed by the weight of the lading carried on the car 10.

The web 94, like the outboard portions 100, is similarly of thinner material such as sheet or plate material ¼ inch thick, and the upper margin 104 of the web 94 is welded to the underside of the bottom plate 56.

A pair of stringers 102 extend longitudinally along the underside of the laterally extending, or outboard, portions of the bottom plate 56 of the center sill 26, providing stiffening support and helping to stabilize the interconnection of the webs 94 of the crossbearers 90 with the bottom plate 56.

Each floor sheet 54 overlaps the respective longitudinally extending side margin 106 of the bottom plate 56 by a small distance and is welded to it. The floor sheet 54 extends outboard and has its outboard margin welded to the side sill 58, whose upper flange forms the outboard-most portion of the cargo-carrying surface of the floor in the intermediate portion 50 of the car 10.

Figure 4:
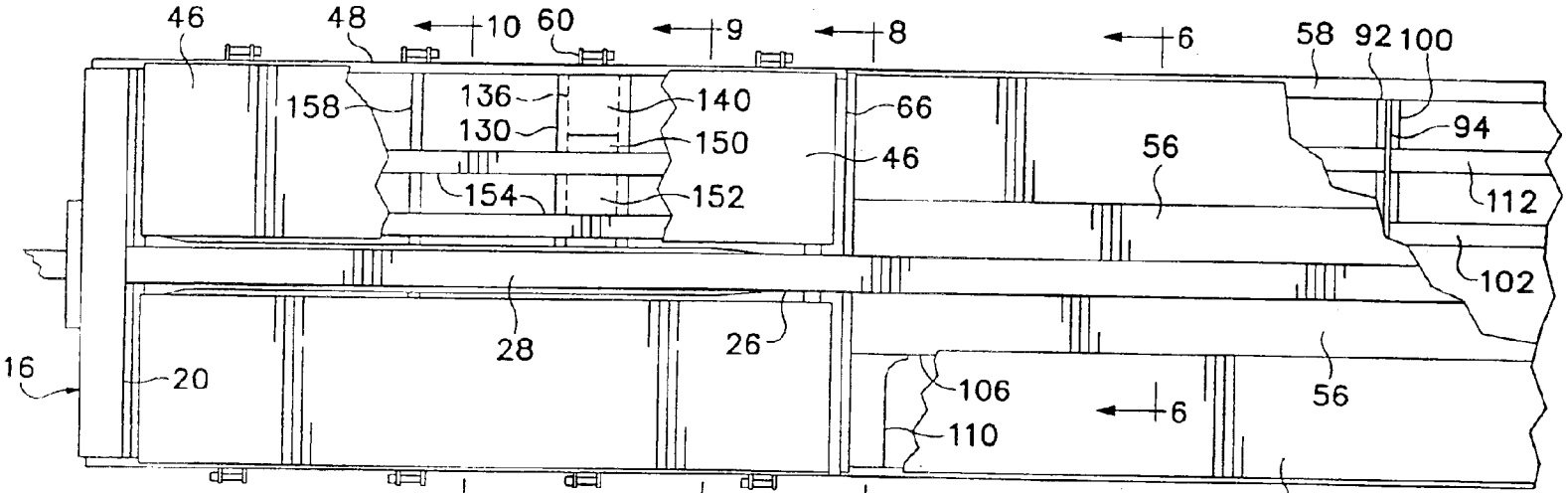
FIG. 4 is a top plan view of a portion of the center beam railroad car shown in FIG. 3.
Figure 5:
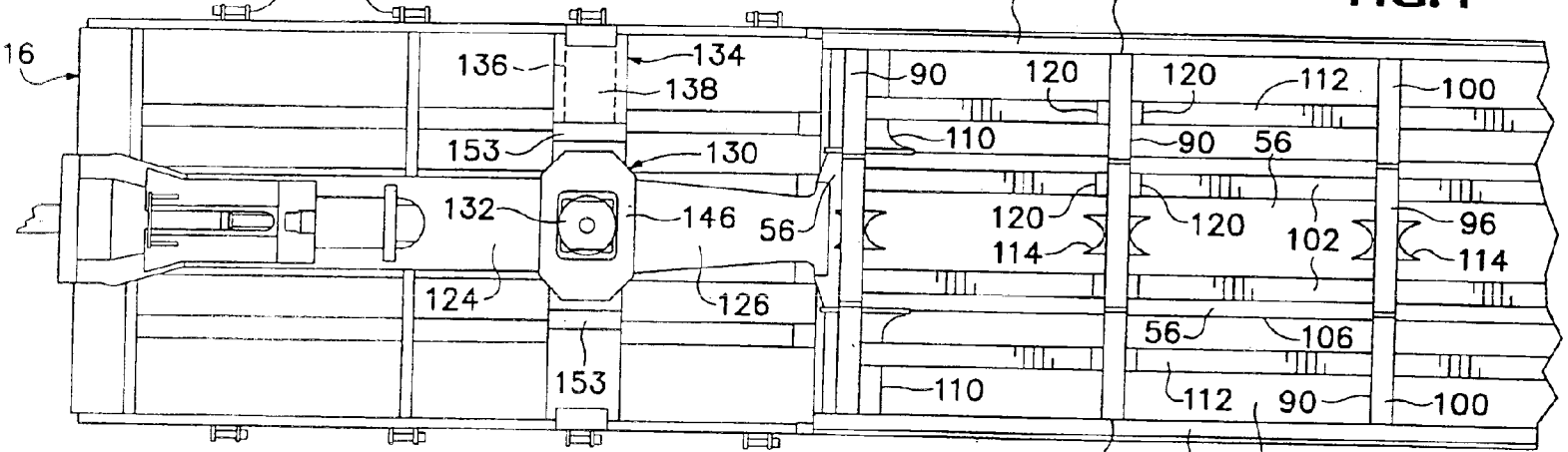
FIG. 5 is a bottom plan view of the portion of the center beam railroad car shown in FIG. 4.
Figure 8:
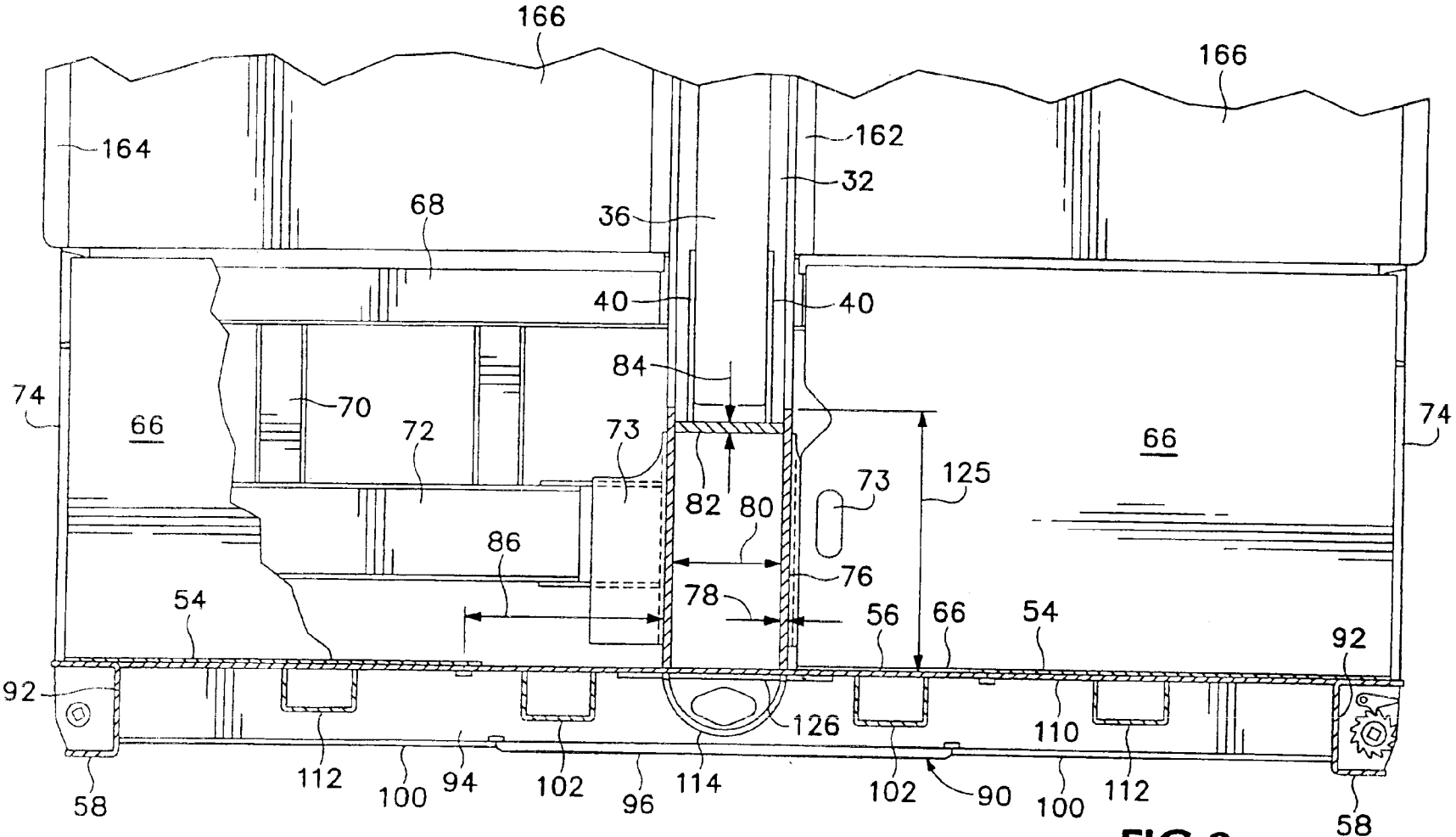
FIG. 8 is a partially cutaway sectional view of the center beam railroad car shown in FIG. 4, taken along line 8—8.

At each end of the intermediate portion 50 of the car body 12 an extension plate 110 extends laterally beneath the floor sheet 54, from the outward margin of the bottom plate 56 to the side sill 58, as may be seen in FIGS. 4, 5 and 8. The web 94 of the crossbearer 90 at each end of the intermediate portion 50 of the car is thus attached to the underside of each of the plates 110, as shown in FIG. 8.

Extending parallel with the stringers 102 are stringers 112 attached to the underside of the floor sheets 54 and to the webs 94 of the crossbearers 90. The floor sheets 54 are preferably of material significantly thinner than the material of the bottom plate 56 of the center sill. For example, the floor sheets 54 may be of 11 gauge sheet steel, i.e., 0.1196 inch in thickness, but they are supported by the bottom plate 56, the side sills 58, the webs 94 of the crossbearers 90, and the stringers 112, and thus provide ample strength to support the types of lading for which the car 10 is intended.

In addition to having their webs 94 welded to the underside of the bottom plate 56 of the center sill 26, the crossbearers 90 are connected with the center sill 26 through gussets 114 which are in the form of tapered, hollow semicylinders, or half-pipes. As shown best in FIG. 7, a pair of parallel upper margins 116 of each gusset 114 are welded to the underside of the bottom plate 56 of the center sill 26, aligned opposite the side plates 76 of the center sill. A semicircular end face 118 of each gusset 114 is welded to the web 94 of a crossbearer 90. Each gusset 114 is tapered to a shorter length further from the bottom plate 56, near the central portion 96 of the crossbearer 90, while the upper margins 116 are longer, to distribute loads from the crossbearer 90 over a significant length of the center sill 26. The gussets 114 may be formed of steel 5⁄16 inch thick, for example.

In order to facilitate installation of the stringers 102 and 112 during construction of the car, a short sleeve 120 fit around one end of each stringer 102 or 112, which is somewhat shorter than the space between crossbearer webs 94 where the stringer fits. The sleeves 120 are welded to the stringers, the underside of the floor plate 54 or bottom plate 56, and the adjacent web 94, while the remainder of each stringer 102 or 112 is welded in place tight against a web 94 at the opposite end of the stringer.

The resulting floor in the intermediate portion 50 is a significantly integrated structure incorporating the stringers 102 and 112 and the crossbearers 90, which, in turn, are securely attached to the underside of the center sill 26, through the web 94 and the gussets 114. The portions of the bottom plate 56 which extend laterally beyond the side plates 76 of the center sill are supported between the crossbearers 90 by the attached stringers 102 and provide part of the cargo-carrying floor surface. The center sill 26 is thus reinforced by the floor structure just described, which serves as part of a wide bottom chord of the center beam whose columns 30, 32 and 34 and diagonal members 36 extend upward to the top chord 28.

The intermediate portion 50 of the car 10 preferably has a length 122, established by the distance between the shear plates 66, that is related to a multiple of the usual length of packages of goods which the car 10 is intended to carry. For example, the distance 122 may be 40 feet 6 inches, allowing five bundles of lumber or sheet of plywood each 8 feet long and 4 feet wide to fit in the intermediate portion 50 of the car between the shear plates 66 and below the height of the end portion floors 44. The lading can thus be conveniently stacked on the depressed floor to a height equal to the height difference 62, above which the lading of the car can extend over a greater length established by the distance between the bulkheads 20 and 22, which is also preferably related to the usual cargo package size.

In the intermediate portion 50 of the car 10, the depth 125 of the center sill 26, established by the vertical height of the side plates 76, is greater than in the end portions 42 of the car 10. The center sill 26 is also narrower in the intermediate portion 50 than in the end portions 42. Because the floor 44 of each end portion 42 is located above the stub end portions 124 of the center sill 26, and because it is desirable for the car to rest as low as practical on the trucks 14, in order to minimize the height of the center of gravity of the car 10, the stub end portions 124 are wider but shallower, as may be seen clearly in FIGS. 3 and 5 and by comparison between FIGS. 8 and 9.

A sloping portion 126 of the bottom plate of each stub end portion 124 of the center sill 26 is welded to the bottom plate 56 beneath the reinforced shear plates 66, as shown best in FIG. 5. The sloping portion 126 and the horizontal portion 128 of the bottom plate of the stub end portions 124, shown also in FIG. 9, have a greater thickness than the bottom plate 56, and may be, for example, ¾ inch thick. A top plate 129 of the stub end portions 124 of the center sill 26 is of relatively thick plate, for example, ½ inch thick.

Figure 9:
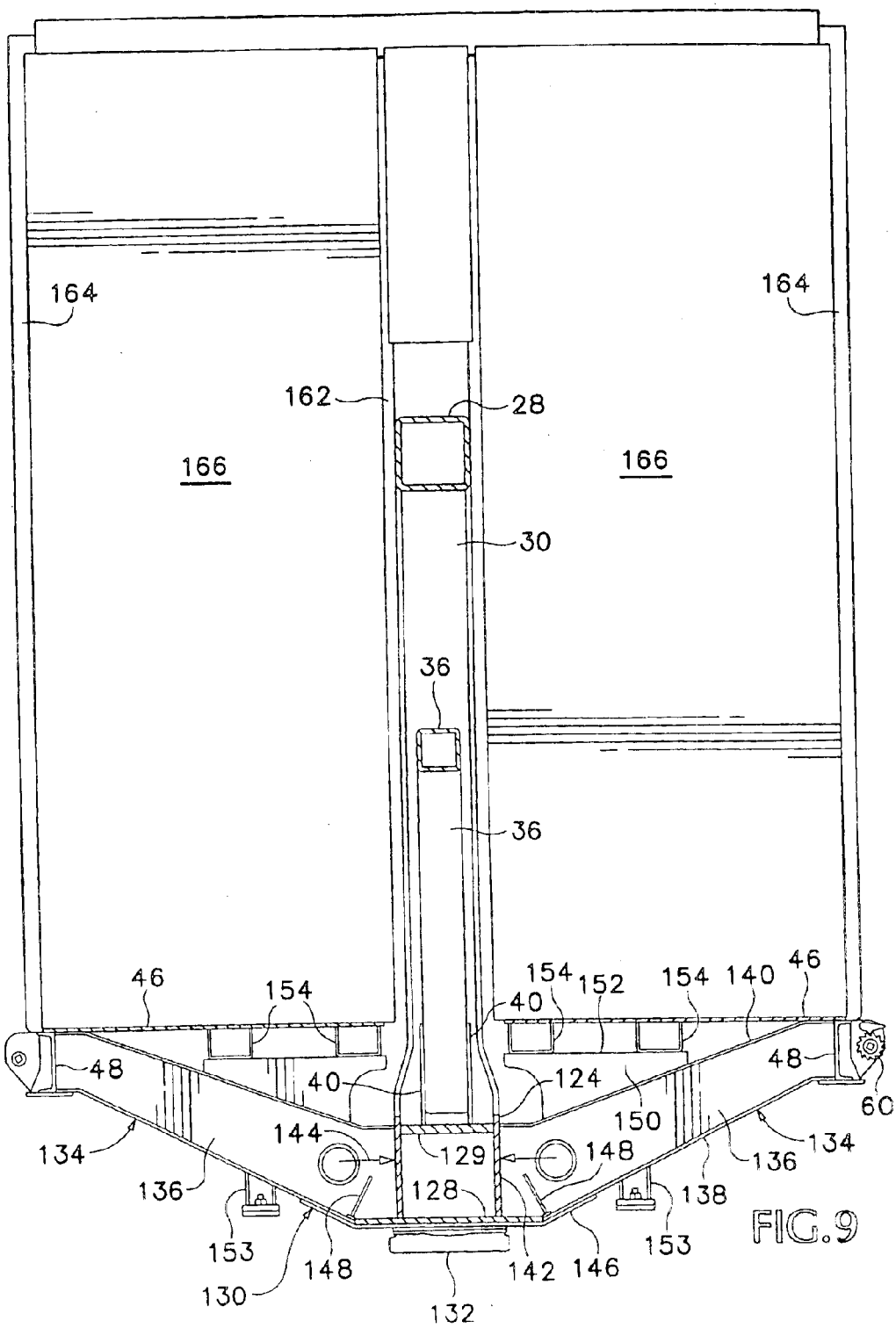
FIG. 9 is a sectional view of the center beam railroad car shown in FIG. 4, taken along line 9—9.

Interconnected with the stub end portions 124 of the center sill 26 in each of the end portions 42 is a respective body bolster 130 which rests atop the wheeled truck 14 that supports that end of the car body 12. As shown in FIG. 9, a center bearing 132 is associated with the bottom of the body bolster 130.

A pair of lateral arms 134 extend laterally outward and diagonally upward from the stub end portion 124 of the center sill to the upper or end portion side sills 48, and each is welded to the respective side sill 48. Each arm 134 includes a pair of upright transverse plates, or side plates 136, tapered and extending outwardly from the center sill, parallel with each other and spaced apart from each other in a direction parallel with the length of the car 10. The side plates 136 are interconnected with each other by a bottom plate 138 and a top plate 140 that extend longitudinally of the car body 12 beyond each side plate 136 so that each arm 134 has the form of a tapered flanged box beam. The bottom plate 128 of the stub end portion 124 of the center sill 26 extends laterally outward beyond each of its side plates 142 for a distance of about one-half the width 144 of the stub end portion 124, and so the bottom plate 138 of each arm 134 is welded to an adjacent portion of the lateral margin of the bottom plate 128 of the stub end portion 124.

A tie plate 146 which may be ½ inch thick extends along a portion of each bottom plate 138 and the bottom plate 128, providing an additional thickness of material to carry the loads encountered where the arms 134 are interconnected with the stub end portion 124, and gussets 148 provide additional reinforcement along the margins of the bottom plate 128.

Mounted atop each of the arms 134 of the body bolster 130 is a floor support riser 150 in the form of a downwardly open U-shaped channel that provides a flat horizontal top face 152 and has sides aligned with the side plates 136.

A side bearing foundation 153 is integrated with the lower side of each arm 134, and extends downward beneath the bottom plate 138, as may be seen in FIGS. 2, 5 and 9.

A pair of longitudinally extending floor support stringers 154, preferably in the form of channels similar to the stringers 102 and 112, are mounted atop the horizontal top face 152, and are welded to the underside of the end portion floor sheet 46 on each lateral side of the car body 12. The stringers 154 extend longitudinally from the reinforcement channel 68 supporting the shear plate 66 to the end sill 156 located beneath the bulkhead 20, in order to provide support for the floor sheets 46, which are preferably of 11 gauge sheet steel (0.1196 inch thick).

As shown in FIG. 10, the stringers 154 are also supported between the body bolster 130 and the end sill 156 by a transversely extending support member 158, preferably in the form of a channel of bent sheet steel thick and having horizontal flanges and a vertical web. The support members 158 each extend from a side sill 48 laterally inward to a support plate 160 welded to and extending upward from a respective side plate 142 of the stub end portion 124 of the center sill 26, as shown in FIG. 10.

Each stub end portion 124 houses appropriate gear to support a conventional coupler at each end 16 or 18 of the car body 12.

Each bulkhead 20 or 22 extends upwardly above the respective end sill 156, and preferably includes a closed section central column 162 fabricated of a pair of channels connected by flat plates, and a pair of side columns 164 in the form of outwardly facing channels, with a pair of face plates 166 on each bulkhead 20 or 22 facing toward the opposite end 16 or 18 of the car body. Each face plate 166 is reinforced by horizontal channels 168 welded to the outboard side of each bulkhead 20 and 22 between the central column 162 and each column 164, as shown in FIG. 2.

Figure 13:
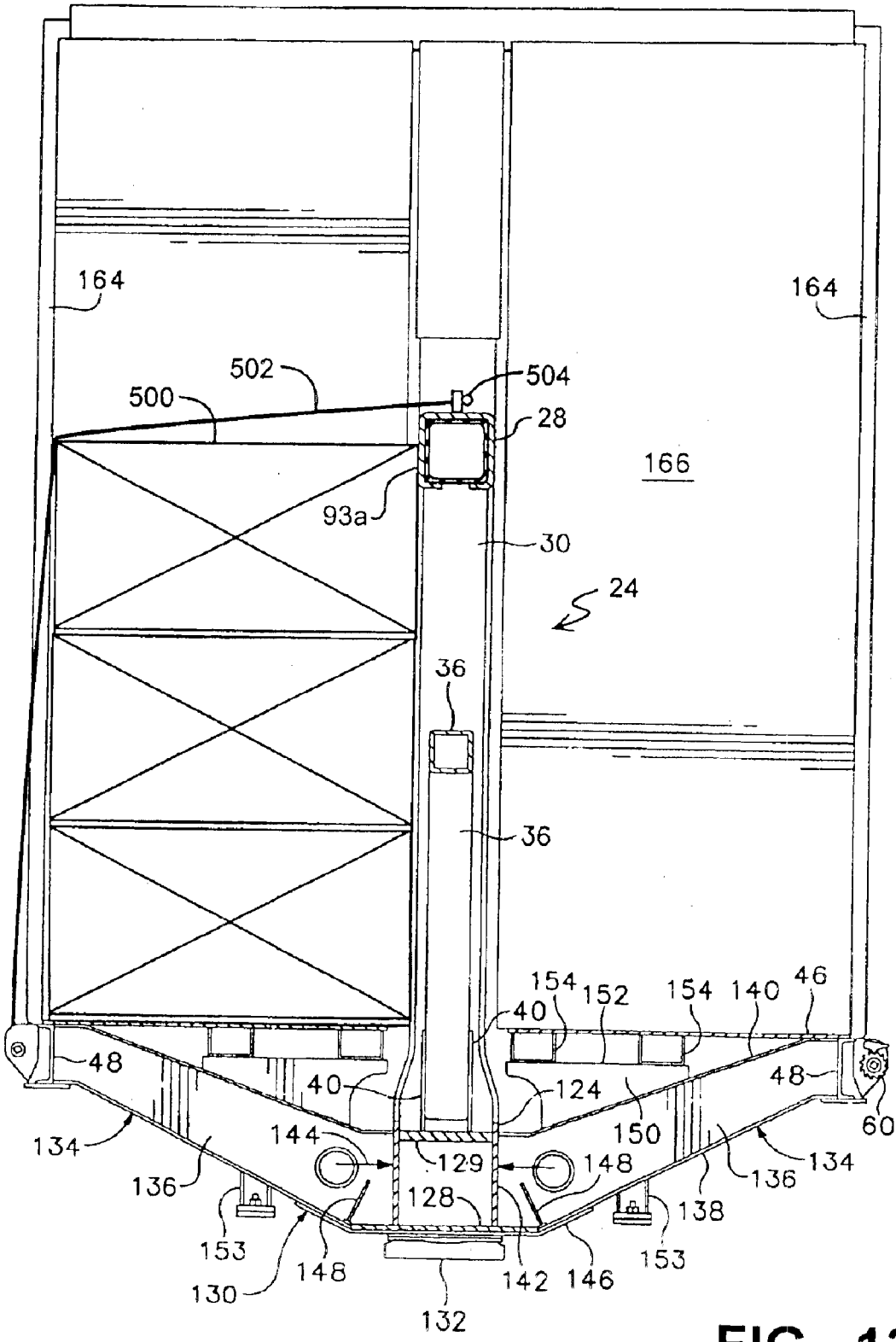
FIG. 13 is a sectional view of the center beam railroad car shown in FIG. 4, taken along line 9—9 and illustrating placement of cargo on the car.
Figure 14:
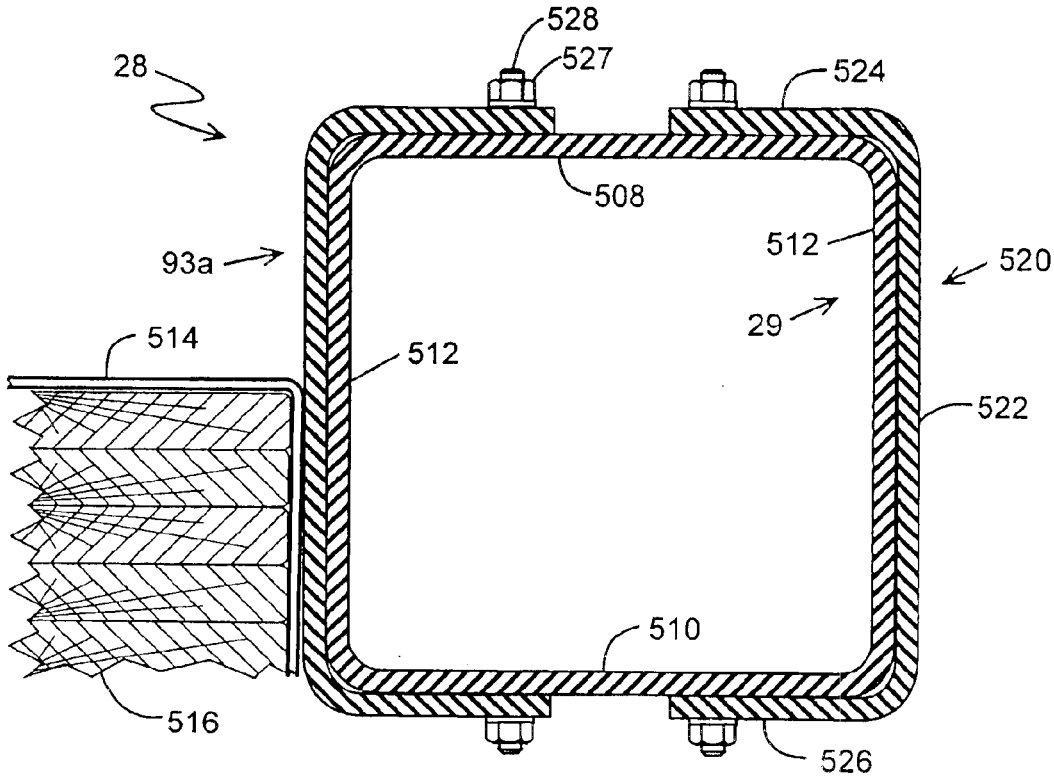
FIG. 14 is a sectional view of the top chord of the center beam of the railroad car shown in FIG. 4, taken along 9—9.
Figure 15:
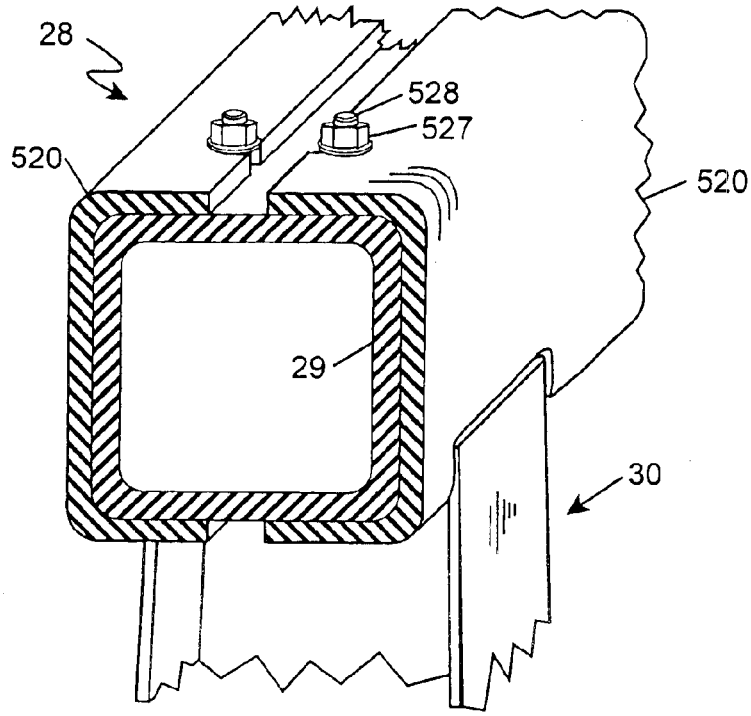
FIG. 15 is a perspective view of a portion of the center beam top chord illustrated in FIG. 14.

Referring to FIGS. 13,14, and 15, the cargo 500 of the center beam railroad car 10 is stacked on the floor 44 of the car on both sides of the center beam 24. Additional bundles of cargo 501 may be stacked above the center beam 24. If a plurality of bundles 501 are stacked across the car above the center beam 24, the bundles are typically stacked to abut along their inboard sides to aid in stabilizing the load. Straps or cables 502 run over the cargo to cargo tie-down strap spools 60 at the periphery of either side of the car. When the straps or cables 502 are tightened, the stacked cargo 500 is pulled toward the center of the car 10 and the upper inboard corner of the cargo stack comes into contact with the lateral face 93*a* of the top chord 28 of the center beam 24 which resists further lateral displacement of the cargo.

The internal structure of top chord 28 of the center beam 24 is typically a hollow rectangular beam or tube 29, for example, a section of 10"×10" square steel tubing of ½-inch wall thickness having a top wall 508, a bottom wall 510 and lateral walls 512. The cargo is typically covered by a protective plastic sheet 514 that becomes trapped between the goods 516 and the lateral face 93*a* of the top chord 28 when the straps or cables binding the cargo are tightened. Typically, center beam rail cars are not enclosed and the plastic sheet 514 is intended to protect the goods 516 from exposure to moisture, dirt, and sand that is encountered during transit.

When the car is in motion it vibrates and changes speed and direction and the cargo moves relative to the car's structure. The upper corner of the stacked cargo 500 in contact with the lateral face 93*a* of the top chord 28 of the center beam 24 moves relative to the lateral face in directions generally parallel to the face. While the protective sheeting 514 can be damaged by sharp edges of various elements of the center beam structure, the present inventors concluded that friction between the protective sheeting 514 and the lateral face 93*a* of the top chord 28 can cause the sheeting to be abraded, eventually exposing the goods 516 to the elements. The goods 516 transported by center beam rail cars are often wood products and the value of the cargo can be substantially reduced by the presence of dirt and sand embedded in the surface of the wood or by discoloration of the wood by mold or mildew following exposure to moisture.

To protect the sheeting 514 from wear and, thereby, to protect the goods 516 from the elements, the lateral faces 93*a* of the top chord 28 of the center beam 24 comprise a material presenting a smooth surface and a low coefficient of friction to the protective sheeting 514 covering the goods 516. The lateral surface 93*a* of the top chord 28 may be constructed of any material exhibiting a relatively low coefficient of friction with the protective cargo sheeting which commonly comprises polyethylene but which may comprise another common plastic. One suitable material for the lateral face 93*a* of the top chord is an ultra-high molecular weight polyethylene.

In one embodiment, the lateral face 93*a* of the top chord 28 is an outer surface of a top chord cover 520 that is interposed between the lateral wall 512 of the top chord tube 29 and the plastic sheeting 514 covering the goods 516. Lateral displacement of the cargo 500 is resisted by the compression of the top chord cover 520 between the cargo 500 and the lateral wall 512 of the top chord tube 29. The top chord cover 520 for the top chord 28 is selectively removable to permit the cover to be replaced when worn or damaged and to permit covers comprising materials that are particularly suited to certain cargoes or cargo coverings to be installed when appropriate.

In a first embodiment, the top chord cover 520 comprises, generally, a channel-shaped cross-section having a channel base 522 having one side that forms the lateral face 93*a* and covering substantially all of the lateral wall 512 of the top chord tube 29. The top chord cover 520 also comprises a top leg 524 and a bottom leg 526 that fit over portions of the top 508 and bottom 510 walls of the top chord tube 29. The top chord cover 520 is selectively affixable to the top chord tube 29 and clamped to the top chord tube by nuts 527 that engage studs 528 welded to the top wall 508 and bottom wall 510 of the tube. Clamping the top chord cover 520 to the top wall 508 and bottom wall 510 of the top chord tube 29 presents a smooth, low friction, lateral face 93*a* of the top chord 28 for contact with the cargo 500.

Figure 16:
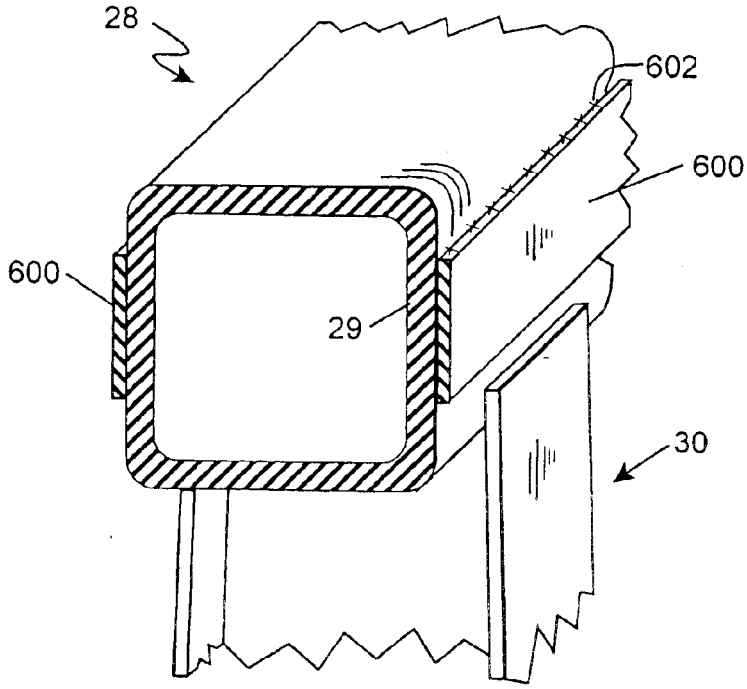
FIG. 16 is a perspective view of a top chord and another embodiment of a top chord cover.

Referring to FIG. 16, in another embodiment, a top chord cover 600 is adhered to a lateral wall 512 of the top chord tube 29 with an adhesive 602 compatible with the material of the top chord cover and the top chord tube. The top chord cover 600 may be selectively removed from the lateral wall 512 by breaking the adhesive joint.

Figure 17:
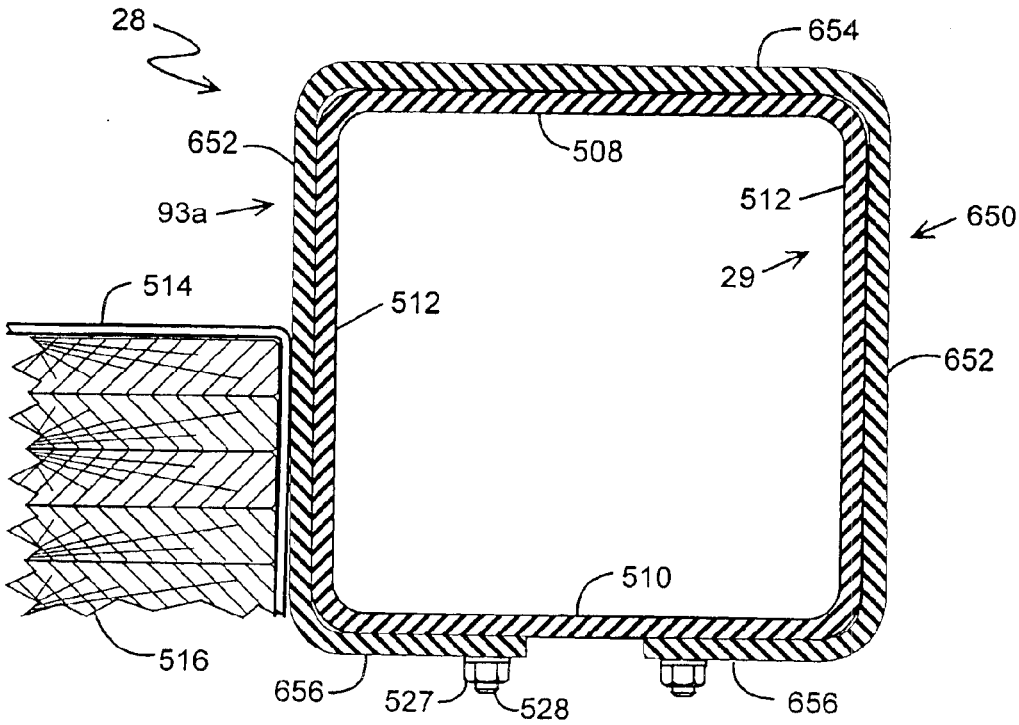
FIG. 17 is a sectional view taken along 9—9 of the top chord of a center beam of the railroad car and a top chord cover of still another embodiment.
Figure 18:
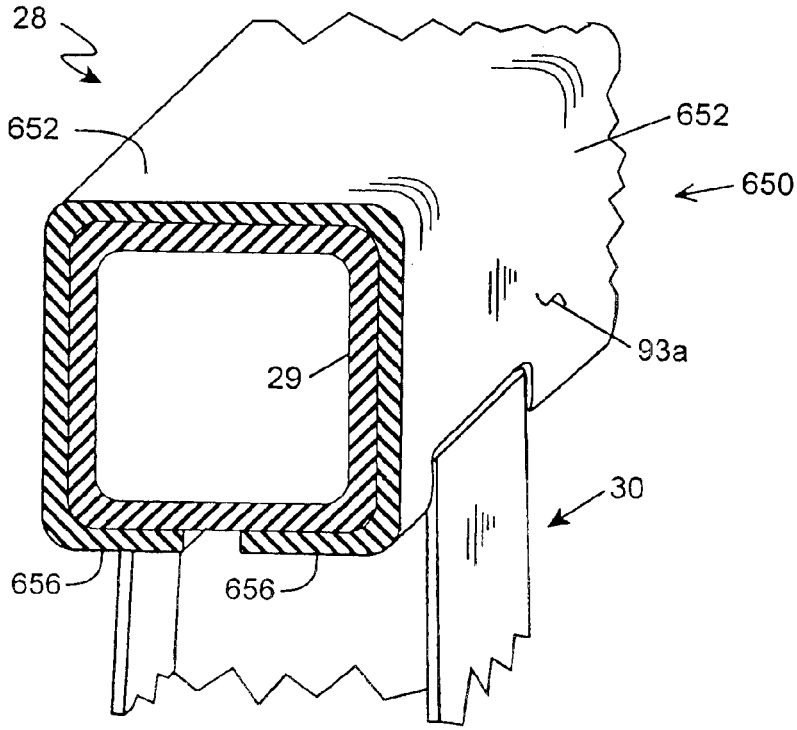
FIG. 18 is a perspective view of the top chord and the embodiment of the top chord cover illustrated in FIG. 17.

Referring to FIGS. 17 and 18, in still another embodiment, the top chord cover 650 comprises, generally, a channel of C-shaped cross-section with a pair of sides 652 each having one surface that forms the lateral face 93*a* and a second surface supported by and substantially coextensive with the outer surface of the lateral wall 512 of the top chord tube 29. The top chord cover 650 also comprises a web 654 that connects the sides 652 and which extends substantially coplanar to the top wall 508 of the top chord tube 29 when the cover is installed. A bottom leg 656 extends laterally from each of the sides 652, fitting over the corner formed by the bottom surface and the lateral wall 512 and extending over a portion of the bottom surface of the top chord tube 29 in an interfering relationship. The web 654 and the sides 652 of the top chord cover 650 are sufficiently flexible to permit installation of the top chord cover 650 by separating the bottom legs 656 to create a gap sufficiently wide to permit the width of the top chord tube 29 to pass between the ends of the legs. When released, the top chord cover 650 returns to its original shape substantially encircling the perimeter of the cross-section of the top chord tube 29. Additional security for the top chord cover 650 is provided by nuts 527 engaging studs 528 welded to the bottom wall 510 and clamping the legs 656 to the bottom of the top chord tube 29. The top chord cover 650 provides a smooth upper surface eliminating traps for dirt and moisture, reduces the number of parts to simplify installation and repair, and presents a smooth, low friction, top chord lateral face 93*a* for contact with the cargo 500.

The railroad car 10 with the structure described above is amply strong yet lighter in tare weight than previously known railroad freight cars of depressed floor center beam construction, and thus is potentially cheaper to construct and to operate.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a freight-carrying, center-beam railroad car having a pair of opposite sides, a length, and a pair of opposite ends, a car body, comprising:

(a) a cargo supporting floor extending substantially between said opposite sides and said opposite ends; and (b) a center beam extending along said body, said center beam including a center sill extending longitudinally along said body, and a top chord extending parallel with and spaced upwardly above and apart from said center sill, said top chord having a selectively affixable member including a lateral face arranged to contact a cargo supported by said floor and resist a lateral displacement thereof in a direction substantially normal to said lateral face.

2. The car body of claim 1 wherein said selectively affixable member including a lateral face of said top chord comprises a material having a low coefficient of friction, said coefficient of friction facilitating a displacement of said cargo in a direction substantially parallel to said lateral face.

3. The car body of claim 2 wherein said material having a low coefficient of friction comprises polyethylene.

4. In a freight-carrying, center-beam railroad car having a pair of opposite sides, a length, and a pair of opposite ends, a car body, comprising:

(a) a cargo supporting floor extending substantially between said opposite sides and said opposite ends;

(b) a center beam extending along said body, said center beam including a center sill extending longitudinally along said body, and a top chord extending parallel with and spaced upwardly above and apart from said center sill, said top chord having a top, a bottom, and a lateral wall arranged to resist a displacement of a cargo supported by said floor in a direction normal to said lateral wall; and (c) a top chord cover selectively affixable to said top and said bottom of said top chord and extending therebetween to substantially cover said lateral wall of said top chord.

5. The car body of claim 4 wherein said top chord cover comprises a material having a low coefficient of friction, said coefficient of friction facilitating a displacement of said cargo in a direction parallel to said lateral face.

6. The car body of claim 5 wherein said material having a low coefficient of friction comprises polyethylene.

7. In a freight-carrying center-beam railroad car having a pair of opposite sides, a length, and a pair of opposite ends, a car body, comprising:

(a) a center beam extending longitudinally along said body, the center beam including (i) a center sill extending longitudinally along said body, (ii) a top chord parallel with and spaced upwardly above and apart from said center sill, and (iii) an upright member extending between said center sill and said top chord;

(b) wherein said center sill includes a top plate and a side plate, said side plate having a first lateral face and extending upward a distance above said top plate and including an upper margin;

(c) wherein said unright member includes a flange plate having a second lateral face, a bottom margin of said flange plate being welded to said upper margin of said side plate with said first and second lateral faces located in a common plane; and (d) wherein said top chord includes a selectively affixable top chord cover including a lateral face arranged to contact a cargo of said car and resist a displacement of said cargo substantially normal to said top chord.

8. The car body of claim 7 wherein said side plate of said center sill is thicker than said flange plate, and including a backing bar extending closely along an inner side of said flange plate and in contact with said upper margin of said side plate of said center sill.

9. The car body of claim 7 wherein said selectively affixable top chord cover and said flange plate are located in said common plane.

10. The car body of claim 7 wherein said top chord cover comprises a material having a low coefficient of friction, said low coefficient of friction facilitating displacement of said cargo in a direction parallel to said lateral face.

11. The car body of claim 10 wherein said material having a low coefficient of friction comprises polyethylene.

12. In a freight-carrying, center-beam railroad car having a pair of opposite sides, a length, and a pair of opposite ends, a car body, comprising:

(a) a cargo supporting floor extending substantially between said opposite sides and said opposite ends;

(b) a center beam extending along said body, said center beam including a center sill extending longitudinally along said body, and a top chord extending parallel with and spaced upwardly above and apart from said center sill, said top chord having a top, a bottom, and a lateral wall arranged to resist a displacement of a cargo supported by said floor in a direction normal to said lateral wall; and (c) a top chord cover comprising a web, a pair of sides connected by and projecting substantially normal to said web, and a leg projecting from at least one of said sides, said top chord cover arranged for selective engagement with said top chord wherein said sides are substantially coextensive with said lateral wall, said web is substantially coplanar with said top wall, and said leg is in an interfering relationship with said bottom wall.

13. The car body of claim 12 wherein said top chord cover comprises a material having a low coefficient of friction, said low coefficient of friction facilitating displacement of said cargo in a direction parallel to said lateral face.

14. The car body of claim 12 wherein said material having a low coefficient of friction comprises polyethylene.

15. In a freight-carrying, center-beam railroad car having a pair of opposite sides, a length, and a pair of opposite ends, a car body, comprising:

(a) a cargo supporting floor extending between said opposite sides and said opposite ends;

(b) a center beam extending longitudinally along said body, said center beam including a center sill extending longitudinally along said body and a top chord extending parallel with and spaced upwardly above and apart from said center sill said top chord having a top surface and opposed side surfaces; and (c) a member selectively affixable to and removable from said top chord, said member extending over at least a portion of said top surface and presenting a smooth, non-abrasive lateral face arranged to contact, and substantially avoid damage to, protective sheeting material on cargo.

16. The car body of claim 15 where said top chord has a bottom surface and said member extends over at least a portion of said bottom surface.

17. The car body of claim 15 wherein said lateral face of said member is of a material having a low coefficient of friction, said coefficient of friction facilitating a displacement of said cargo in a direction substantially parallel to said lateral face.

18. The car body of claim 17 wherein said lateral face of said top chord cover is of a material having a low coefficient of friction.

19. In a freight-carrying, center-beam railroad car having a pair of opposite sides, a length, and a pair of opposite ends, a car body, comprising:

(a) a cargo supporting floor extending between said opposite sides and said opposite ends;

(b) a center beam extending longitudinally along said body, said center beam including a center sill extending longitudinally along said body and a top chord extending parallel with and spaced upwardly above and apart from said center sill, said top chord having a top wall and a lateral wall; and (c) a top chord cover extending over a portion of said top wall and substantially covering said lateral wall, said top chord cover being selectively affixable to and removable from said top wall and having a smooth lateral face facilitating displacement of said cargo in a direction parallel to said lateral face.

20. In a freight-carrying, center-beam railroad car having a pair of opposite sides, a length, and a pair of opposite ends, a car body, comprising:

(a) a cargo supporting floor extending between said opposite sides and said opposite ends;

(b) a center beam extending longitudinally along said body, said center beam including a center sill extending longitudinally along said body and a top chord extending parallel with and spaced upwardly above and apart from said center sill, said top chord having a top wall; and (c) a top chord cover selectively affixable to, and removable from, said top wall and presenting a smooth, nonabrasive lateral face arranged to contact, and substantially avoid damage to, a protective sheeting material on cargo.

* * * * *